United States Patent [19]

Airaksinen et al.

[11] Patent Number: 5,027,729

[45] Date of Patent: Jul. 2, 1991

[54] METHOD OF MANUFACTURING A POCKET CONSTRUCTION PROVIDED WITH A WELT

[75] Inventors: Pentti Airaksinen, Ulvila; Reijo Leppäniemi, Pori; Matti Miettinen, Pori; Jarmo Pohjolainen, Vahna-Ulvila; Seppo Varjus, Kaasmarkku, all of Finland

[73] Assignee: Cimcorp Oy, Ulvila, Finland

[21] Appl. No.: 469,551

[22] PCT Filed: Oct. 7, 1988

[86] PCT No.: PCT/FI88/00162

§ 371 Date: Mar. 22, 1990

§ 102(e) Date: Mar. 22, 1990

[87] PCT Pub. No.: WO89/03184

PCT Pub. Date: Apr. 20, 1989

[30] Foreign Application Priority Data

Oct. 13, 1987 [FI] Finland ..... 874515
Oct. 7, 1988 [WO] PCT Int'l Appl. ... PCT/FI88/00162

[51] Int. Cl.[5] ..... D05B 21/00; A41D 27/20
[52] U.S. Cl. ..... 112/262.1; 2/247
[58] Field of Search ..... 112/18, 52, 262.1, 262.3, 112/265.1; 2/247

[56] References Cited

U.S. PATENT DOCUMENTS

| | | | |
|---|---|---|---|
| 1,832,214 | 11/1931 | Jenkins | 2/247 |
| 2,282,545 | 5/1942 | Rosenstein | 2/247 |
| 3,105,973 | 10/1963 | Stiefelmeier | 2/247 |
| 3,725,959 | 4/1973 | Cruden | 2/247 |
| 3,870,000 | 3/1975 | Ferré et al. | 2/247 X |
| 4,263,678 | 4/1981 | Off | 2/247 |
| 4,315,793 | 2/1982 | Off et al. | 156/443 |
| 4,349,920 | 9/1982 | Off | 2/247 |
| 4,445,233 | 5/1984 | Rubin | 2/247 X |
| 4,756,261 | 7/1988 | Gershoni | 112/262.3 |

*Primary Examiner*—Werner H. Schroeder
*Assistant Examiner*—Ismael Izaguirre
*Attorney, Agent, or Firm*—Scully, Scott, Murphy & Presser

[57] ABSTRACT

The present invention relates to a method of manufacturing a pocket construction provided with a welt. In order to provide a simple, efficient and automatable process of manufacture, a pocket pouch blank (8) is brought on the reverse side of a garment (3); at the ends of a future pocket slot (4) are punched V-shaped slits, the points of the slits pointing at each other, and the triangular points (15, 16) so formed are secured in their folded position at the same time securing the garment (3) and the pocket pouch blank (8) to each other, the pocket slot (4) is cut open, a lower welt (7) is brought partially on the pocket slot (4) and partially on the lower edge (6) thereof and secured to this lower edge (6) by a stitch (10), and an inner pocket pouch panel (2) is secured on the outer pocket pouch panel (1) to form a pocket pouch.

9 Claims, 2 Drawing Sheets

METHOD OF MANUFACTURING A POCKET CONSTRUCTION PROVIDED WITH A WELT

BACKGROUND OF THE INVENTION

1. FIeld of the Invention

This invention relates to a method of manufacturing a pocket construction provided with a welt, which comprises a pocket pouch with an inner panel and an outer panel, whereby the outer panel is closer to a garment, a slot provided by forming a slit through the garment and the outer pocket panel, the ends thereof being formed into the shape of a V, and by folding the edges of the slot on the outer pocket panel, and a lower welt partially on the pocket slot and partially on the lower edge of the pocket slot, and is attached by a stitch.

2. Description of the Prior Art

Pocket constructions provided with a welt as described above are very generally used especially as trousers back pockets and jacket side pockets. They are then mostly provided except with a lower welt also with an upper welt or a flap and possibly also a link. A manufacture of such a conventional pocket construction with a welt, which has proved to be good and durable in practice, is, however, difficult and requires many steps including for example the step of turning the pocket pouch with the welts through the slot. An automation of such a process is understandably very complicated and has so far not been possible.

As efforts at manufacturing welt pockets automatically can be mentioned the methods known from U.S. Pat. Nos. 4,315,793 and 4,263,678. The apparatus described in U.S. Pat. No. 4,315,793 is, however, not automatic, but requires a manual removal of a pocket blank from one device unit to another. In the method described in this publication, the welt pocket construction has been simplified and it includes hardly any seams made by sewing, but the seams are manufactured mainly by means of an adhesive technique. This results in that the pocket slot is stiff, and on the other hand, tears easily. A welt pocket construction assembled in a similar manner, i.e. exclusively by adhesive attachment, and reinforced by some stitches only is known from U.S. Pat. No. 4,263,678. The advantage of this construction is that it can be assembled entirely on the reverse side of the garment, but it has also the drawbacks of the abovementioned constructions attached by adhesive.

SUMMARY OF THE INVENTION

The object of the present invention is to provide a new method of manufacturing a conventional welt pocket construction proved to be good, which method is of that nature that it enables a considerably simpler realization of an automatic production line than would be possible when using a conventional method of manufacturing welt pockets. The most essential feature of the method is that it is at no stage of operation necessary to turn the pocket pouch through the pocket slot, and according to the invention, the manufacture of the pocket pouch can entirely take place with the same side of the garment out, which makes it unnecessary to turn the garment, which would complicate the automation. The accomplished welt pocket construction does not, however, differ from the welt pocket construction found to be good in this field.

This object has been reached by means of the method of the invention:

at the ends of a pocket slot are punched V-shaped slits through both the outer pocket pouch panel and the garment, the points of the slits pointing at each other, the triangular points formed by the slits mentioned are folded on the outer pocket pouch panel, the triangular points mentioned are secured in their folded position and simultaneously, the garment and the outer pocket pouch panel are secured to each other within the area of these points, the pocket slot is cut open and the edges of the slot are folded from the level of the garment on the outer pocket pouch panel, the lower welt is brought partially on the pocket slot and partially on the lower edge thereof and is secured to this lower edge by means of a stitch, and the inner pocket pouch panel is placed on the outer pocket pouch panel and secured thereto by means of a stitch to form the pocket pouch.

As the most preferable alternative, though not the only alternative, the triangular points are secured in their turned position and at the same time, the outer pocket pouch panel is secured to the garment at these points by means of heat activated adhesive cloth arranged on both sides of the outer pocket pouch panel before placing it on the garment.

When manufacturing a welt pocket construction provided except with a lower welt also with an upper welt, the procedure is that the upper welt is partially placed on the pocket slot and partially on the upper edge thereof and secured to this upper edge by means of a stitch before placing the inner pocket pouch panel.

When manufacturing a welt pocket construction provided with a pull fastener between the upper and the lower welt, the procedure is that the pull fastener is brought ready-assembled on the upper and lower welts and secured simultaneously with and by means of the same stitches as these welts to the edges of the pocket slot. According to this invention, it is possible to secure the pull fastener ready-assembled, which considerably simplifies the fitting of the pull fastener compared with the conventional procedure. Additionally, it is not necessary to secure the lower and the upper welt and the pull fastener separately, but they can all be secured at the same time.

A welt pocket construction provided with a flap is manufactured in such a way that the flap is brought partially on the pocket slot and partially on the upper edge thereof and secured by means of a stitch to this upper edge before placing the inner pocket pouch panel. Thus, the flap is stitched like the upper welt and possibly at the same time with it on the reverse side of the garment on the outer pocket pouch panel. It can remain in this position during the whole process of manufacture and not be drawn out of the pocket until the products are sold retail, for instance. To enable this, it is, however, necessary that the flap is manufactured in advance, which the welts do not need to be, but they can be formed of a continuous band by means of forming means known per se just before they are secured.

If a welt pocket construction is required to be provided with a link instead of an upper welt or with a flap or a link together with the upper welt, the procedure is in the first case that the link is placed partially on the pocket slot and partially on the upper edge thereof and secured to this upper edge by means of a stitch before placing the inner pocket pouch panel or in the latter case, the flap or the link is placed on the upper welt after attachment thereof and secured to the upper edge of the pocket slot by means of a stitch. The flap or the link can alternatively be secured simultaneously with and by means of the same stitch as the upper welt.

BRIEF DESCRIPTION OF THE DRAWINGS

In the following, the method of manufacturing a welt pocket construction according to the invention is described in more detail referring to the enclosed drawing, whereby.

DESCRIPTION OF THE PREFERRED EMBODIMENT

Figure 1:
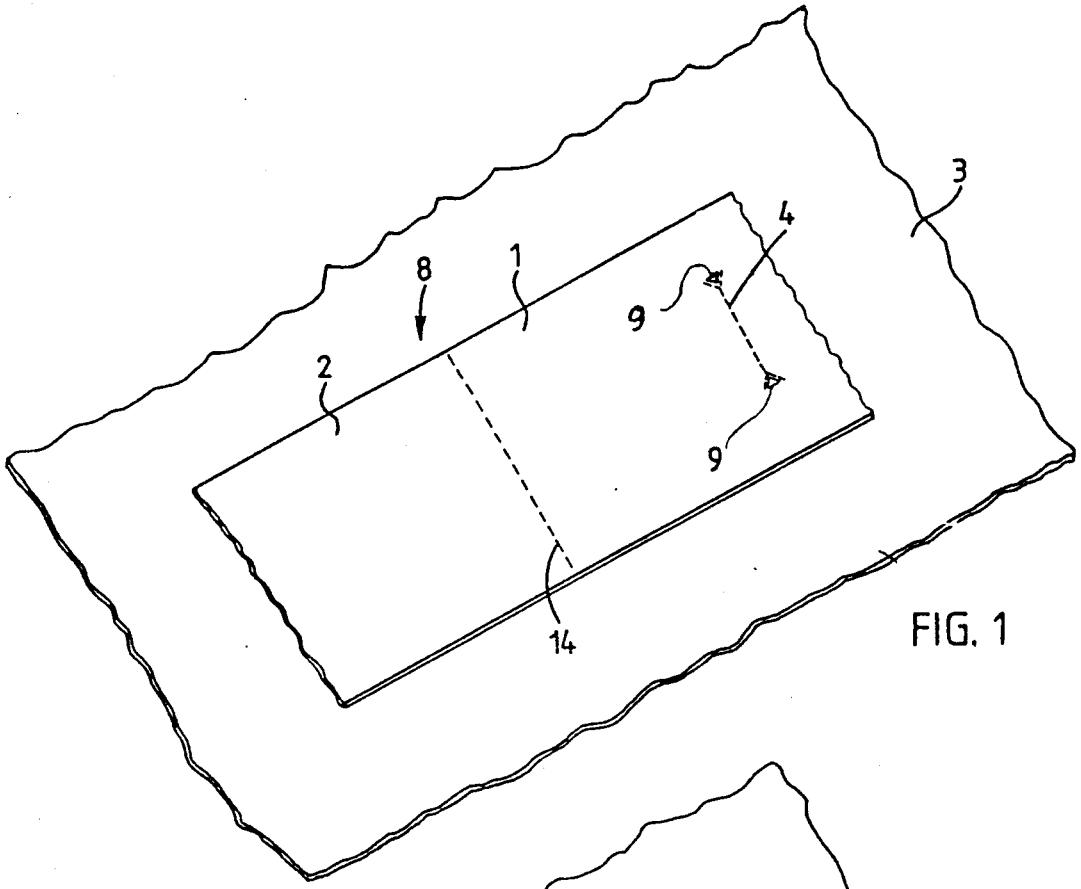
FIG. 1 shows a stage of the method of the invention at which a pocket pouch blank is placed on a garment.

FIG. 1 shows a stage of the method of the invention, at which a pocket pouch blank 8, in the shown embodiment comprising both an outer panel 1 and an inner panel 2, has been placed on a garment 3. Further, FIG. 1 shows by means of broken lines the place of a to be cut pocket slot 4 and the shape of a slit required for its manufacture. Additionally, FIG. 1 shows by means of broken lines and the reference numeral 14 the place of the pocket pouch blank where the outer panel 1 changes into the inner panel 2 and where the inner panel 2 of the pocket pouch blank will be folded on the outer panel 1. In this embodiment, before placing the pocket pouch blank on the garment, pieces 9 of adhesive cloth are secured to the outer pocket panel both on the side next to the garment and on the side away from it in the range of triangular areas joining to the ends of the future pocket slot 4 and remaining within the V-shaped slits.

Figure 2:
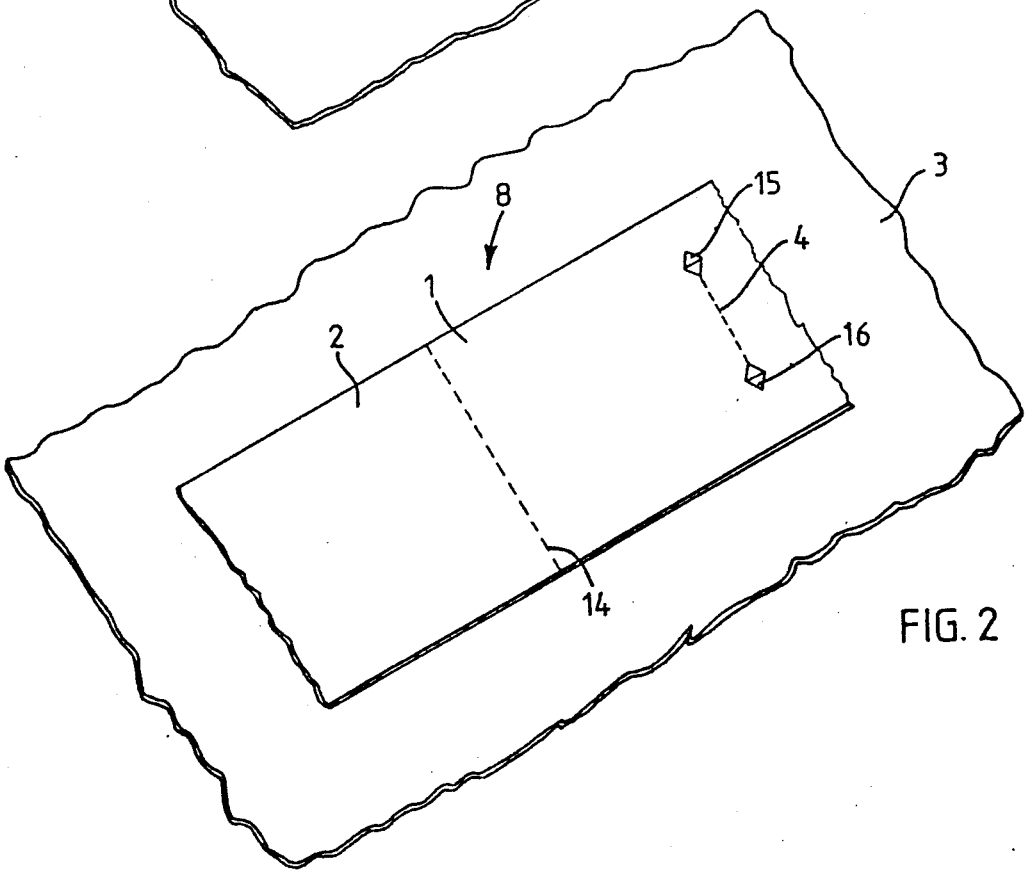
FIG. 2 shows the situation of FIG. 1 after the ends of a pocket slot have been cut open.

FIG. 2 shows a stage of the method of the invention following the stage shown in FIG. 1, at which stage V-shaped slits are made at the ends of the to be cut pocket slot 4 and triangular points 15 and 16 provided in this way are folded on the outer panel 1 of the pocket pouch blank 8 and secured in this position. For the attachment have been used pieces 9 of adhesive cloth on the side away from the garment 3, to which pieces the points 15 and 16 are secured by means of heating by utilizing the adhesiveness of these pieces 9 of adhesive cloth. At the same time, the pieces of adhesive cloth between the garment 3 and the pocket pouch blank 8 within the area of these triangular points 15 and 16 are activated and they secure the garment and the pocket pouch blank to each other within the area of these points. It could certainly be possible to secure the points 15 and 16 in the position desired in another way, too, e.g. by means of adhesive, by stitching or simply by ironing.

Figure 3:
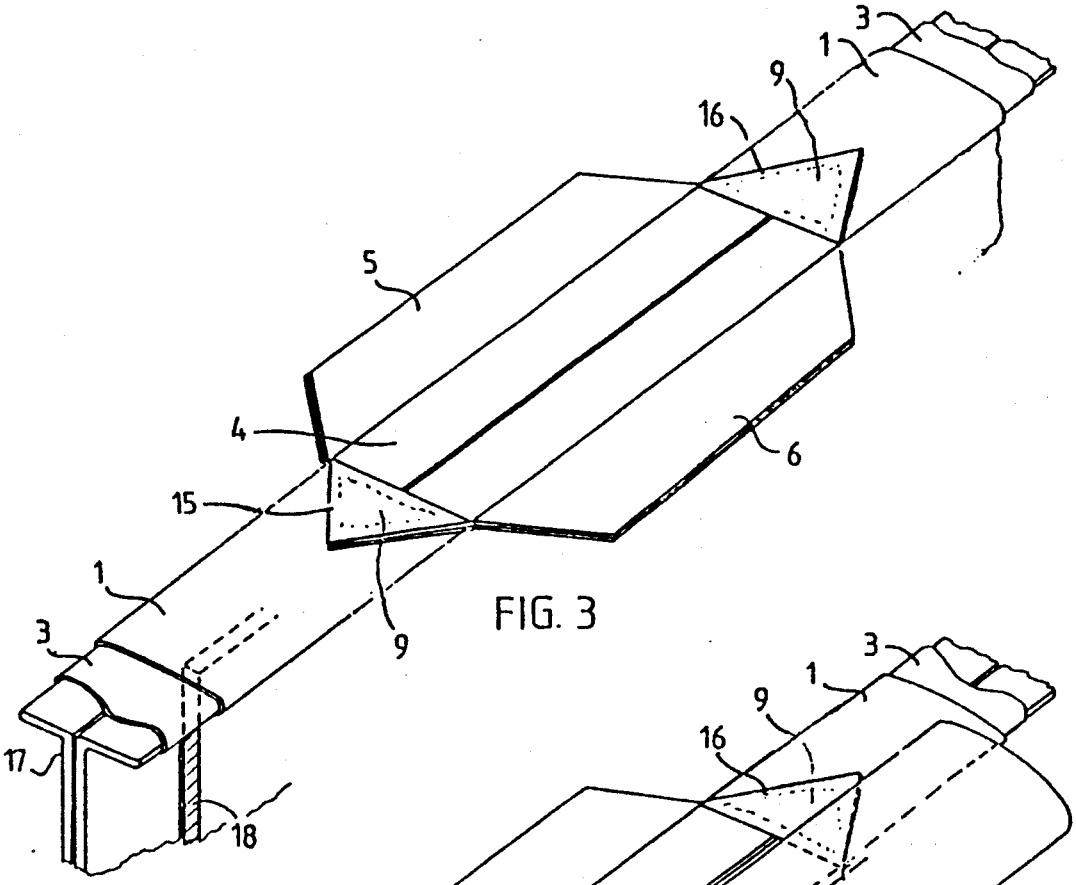
FIG. 3 shows a procedure of the invention for folding the edges of the pocket slot on the outer pocket pouch panel after the pocket slot has been cut open.

FIG. 3 shows the following stage of the method, at which the pocket slot 4 is cut open, whereby the edges 5 and 6 of the pocket slot turn from the level of the garment 3 on the outer panel 1 of the pocket blank For this stage of method, the garment 3 is at first positioned on a substantially T-shaped bench 17, the upper branch of which has a width substantially corresponding to the height of the pocket slot 4 desired This T-shaped bench is actually formed of two L-shaped sections opposite to each other, whereby there is a small groove between them in the upper part just at that place where the pocket slot 4 will be cut open. Naturally, such a T-shaped bench could be manufactured in another way, too, as for instance of a profile extruded or cast into a desired shape, whereby a groove in the upper edge of the bench can, if it is needed, be included in the profile already at the manufacture or it can be cut there later. In this manner, an unnecessary blunting of the cutting tool can be avoided. When the garment 3 with the pocket pouch blank thereon is correctly directed on the bench 17, the parts of cloth surrounding the to be cut pocket slot 4 are pressed against the shaft of the bench 17 by means of presses 18 coming from the side, only one of them being shown in FIGS. 3 and 4, while both of them are seen in FIG. 5. These presses 18 coming from the side stretch the garment 3 with the pocket pouch blank thereon tightly on the bench 17. When a slit is now formed in the middle of the to be cut pocket slot to open the pocket slot, this stretching provided by means of the presses 18 compells the edges of the pocket slot, now consisting of trapezoidal flaps 5 and 6, to turn sidewards to the outer panel 1 of the pocket blank. These edges 5 and 6 of the pocket slot can be made to be located substantially on the level of the upper surface of the bench 17.

Figure 4:
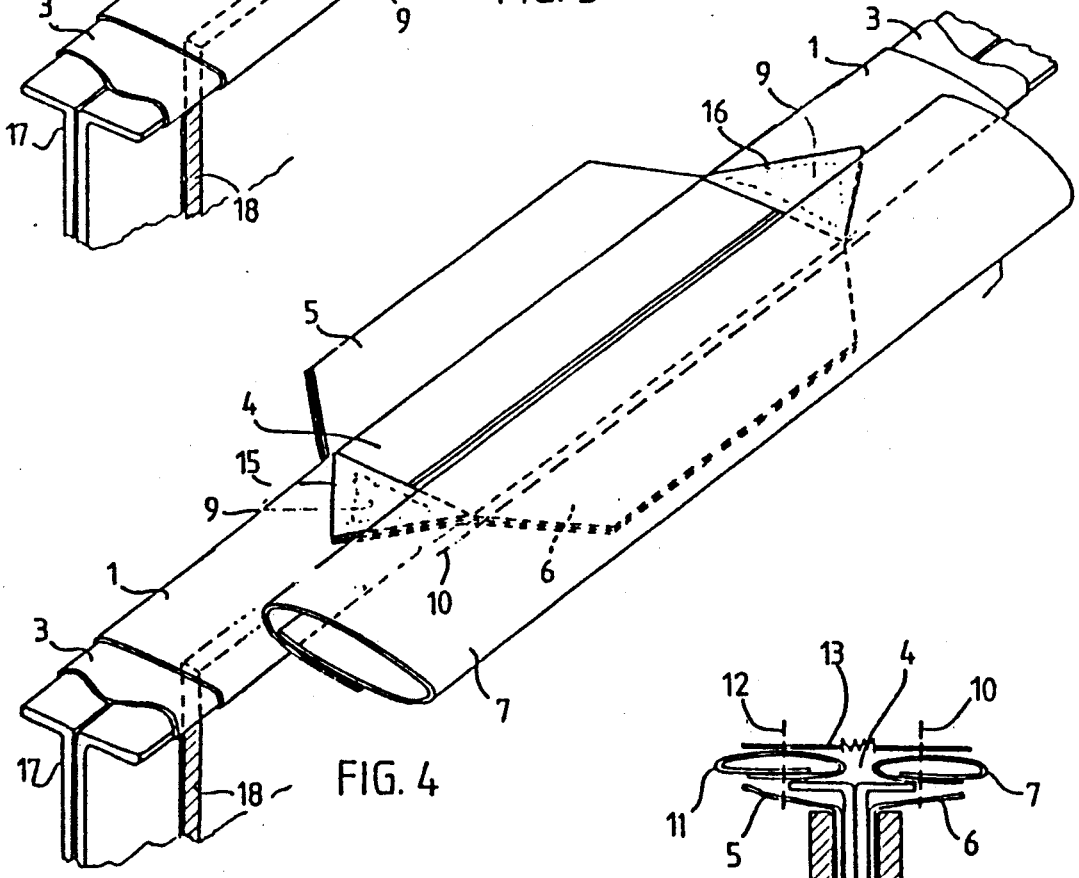
FIG. 4 shows a procedure of the invention for securing a lower welt.
Figure 5:
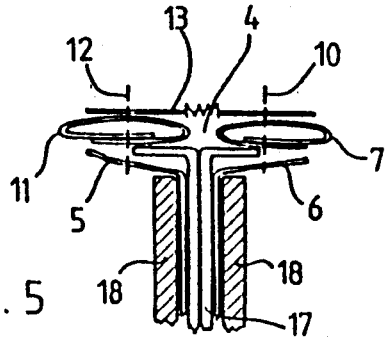
FIG. 5 shows a procedure for manufacturing a pocket slot with a welt, the welt pocket construction comprising both an upper and a lower welt and additionally, a pull fastener.

FIG. 4 shows the following stage of the method of the invention, at which in the situation of FIG. 3 a lower welt 7 is brought on the lower edge 6 of the pocket slot. As appears from FIG. 4, this lower welt 7 is formed of a cloth band wound into a flattened pipe. Thus, such a welt 7 can be formed of a cloth band by feeding it through a suitable forming means directly to the future place of the lower welt. This lower welt 7 partially placed on the pocket slot 4 and partially on the lower edge 6 thereof and cut into a suitable length is secured in place by means of a stitch 10 punching this lower edge 6. As can be seen from FIG. 4, this stitch 10 can be accomplished from the side in such a way that the stitch 10 punches only the lower welt 7 and the lower edge 6 of the slot. Next, the upper welt 11 (FIG. 5) can be placed on the upper edge 5 of the pocket in the same way as the lower welt and stitched in place by means of a stitch 12 (FIG. 5), possibly simultaneously with the stitch 10 by using another sewing machine. Instead of this upper welt 11, flaps or a link or a combination of upper welt and link or a combination of upper welt and flap according to conventional welt pocket constructions can be used. Then the procedure is that the upper welt is at first secured to the upper edge 5 of the pocket slot and a link or a flap is placed thereon, which is secured in place by means of a stitch. If only a link is used, it is secured in the same way as the upper welt. When a flap is used instead of the upper welt or together with it, this flap must be manufactured in advance in a suitable width, whereby this width substantially corresponds to the width of the pocket slot 4. By using the method of the invention, this flap can be secured on the reverse side to the upper edge 5 of the pocket slot, it can be left inside the pocket and not be taken out of the pocket until the product is going to be sold, for instance.

Moreover, FIG. 5 shows how a pull fastener 13 is attached to the welt pocket construction of the invention, which is shown to comprise both the lower welt 7 and the upper welt 11. Then the procedure has been that according to FIG. 4, the lower welt has been placed on the lower edge 6 of the pocket slot and the upper welt 11 has been placed on the upper edge 5 of the pocket slot, whereafter the pull fastener 13 ready-assembled and provided with a clasp has been placed on these welts 7 and 11. After this, the pull fastener 13 has been secured to the edges 5 and 6 of the pocket slot simultaneously with and by means of the same stitches 10 and 12 as the welts 7 and 11. Thus, the method of the invention substantially simplifies the attachment of the pull fastener to the pocket slot compared with the prior automatable methods for the attachment of a pull fastener.

When the pocket slot together with all necessary parts desired at each particular time is readyassembled, the inner panel 2 of the pocket pouch blank is folded over the pocket slot 4 and secured by means of a stitch to the outer panel of the pocket pouch blank to form a pocket pouch. Then the inner panel of the pocket pouch blank can have been before folding attached either to the lower edge of the outer panel, as shown in FIG. 1, or to the upper edge thereof, whereby the fold line thus will be situated at the upper edge of the pocket pouch. In the case shown in FIG. 1, it is preferable to proceed in such a way that the free end of the inner panel 2 of the pocket pouch blank 8 is secured to the outer panel 1 as near the pocket slot as possible, i.e. substantially at the stitch 12 (FIG. 5). For this procedure, the garment 3 is folded downwards, whereby not even this stitch needs to punch the garment. After this, the sides of the pocket pouch and possibly also the bottom are stitched together. It is then possible to use for instance an apparatus which at first cuts the sides and the bottom of the pocket pouch into a shape desired, fits an edge band in a width desired on the edge thereof and secures it then by means of a stitch. In this manner, a pocket pouch of exactly the shape and size desired can be created, and with a very neat appearance, too. Though FIGS. 1 and 2 show the pocket pouch blank 8 comprising both the outer panel of the pocket pouch and the inner panel thereof, it is fully possible that the inner panel is a separate strip of cloth, which at its edges is stitched together with the outer panel of the pocket pouch to form a pocket pouch.

This description of the method of manufacturing a welt pocket construction according to the invention has tried to visualize this method and to describe partially also the apparatuses by means of which this method can be realized as an automatic process. However, the means and apparatuses described have been presented only to visualize the method of the invention and they cannot in any way be considered necessary for carrying out the method of the invention, but the method of the invention is suitable to be carried out even manually, though no significant advantages are then offered compared with the conventional method of manufacture. Further, the method of the invention has been visualized by presenting only one possible method of manufacture, and it is understandable that for instance, the pocket pouch can be closed in many different ways without, however, differing from the scope of protection defined by the enclosed claims.

We claim:

1. A method of manufacturing a pocket provided with a welt which comprises:

(a) placing a pocket pouch blank, having an inner panel (2) and an outer panel (1), into contact with a garment wherein the outer panel is in proximate contact with the garment (3);

(b) punching a set of "V" shaped slits with points facing towards one another, through the garment (3) and the outer panel (1) wherein the "V" shaped slits are positioned such that a pocket slot (4) will extend therebetween;

(c) folding both of two triangles formed by said "V" shaped slits onto prepositioned heat activated adhesive fabric to hold the triangles in a folded position and to secure the outer panel (1) to the garment (3);

(d) folding a lower edge and an upper edge (5, 6) of the slot onto the outer panel (1);

(e) placing a welt (7) partially on the pocket slot and partially on the lower edge (6) of the pocket slot (4) and securing said welt in place by a stitch; and (f) placing the inner panel (2) over the outer panel (1) and securing the same together with a stitch.

2. A method according to claim 1 wherein the pocket pouch blank (8) comprises both the outer (1) and inner (2) pocket pouch panels, and the pocket pouch is formed by folding the inner panel (2) on the outer panel (1) and securing them together by means of a stitch.

3. A method according to claim 1 wherein before placing the inner pocket pouch panel, the edges and ends of the pocket slot are reinforced by means of a stitch.

4. A method according to claim 1, additionally comprising an upper welt (11), wherein the upper welt (11) is placed partially on the pocket slot (4) and partially on an upper edge (5) thereof and secured to said upper edge (5) by means of a stitch (12) before placing the inner pocket pouch panel (2).

5. A method according to claim 4, additionally comprising a pull fastener (13) between the upper and lower welts (11, 7), wherein the pull fastener (13) is placed ready-assembled on the upper and lower welts (11, 7) and secured simultaneously by the stitches (10, 12) holding the welts to the edges (5, 6) of the pocket slot.

6. A method according to claim 4, wherein a flap is placed on the upper welt after the attachment of the welt and secured to the upper edge of the pocket slot.

7. A method according to claim 4, wherein a link is placed on the upper welt after the attachment of the welt and secured to the upper edge of the pocket slot.

8. A method according to claim 1, additionally comprising a flap at the upper edge of the pocket, wherein the flap is placed partially on the pocket slot and partially on an upper edge thereof and secured to said upper edge by means of a stitch before placing the inner pocket pouch panel (2).

9. A method according to claim 1, additionally comprising a link, wherein the link is placed partially on the pocket slot and partially on an upper edge thereof and secured to said upper edge by means of a stitch before placing the inner pocket pouch panel (2).

* * * * *